United States Patent [19]

Weishalla

[11] Patent Number: 4,554,815

[45] Date of Patent: Nov. 26, 1985

[54] TOOL PACK ASSEMBLY

[75] Inventor: Gale F. Weishalla, Maple Grove, Minn.

[73] Assignee: Pride Machine, Inc., Fridley, Minn.

[21] Appl. No.: 533,867

[22] Filed: Sep. 21, 1983

[51] Int. Cl.[4] ..... B21D 22/00

[52] U.S. Cl. ..... 72/349; 72/468

[58] Field of Search ..... 72/347, 348, 349, 468

[56] References Cited

U.S. PATENT DOCUMENTS

| | | | |
|---|---|---|---|
| 3,943,740 | 3/1976 | Bartenstein | 72/349 |
| 4,183,237 | 1/1980 | Schaffer | 72/349 |
| 4,262,572 | 4/1981 | Maeder | 72/45 |
| 4,300,375 | 11/1981 | Maeder | 72/349 |
| 4,324,124 | 4/1982 | Maeder | 72/349 |

*Primary Examiner*—Leon Gilden

*Attorney, Agent, or Firm*—James R. Cwayna

[57] ABSTRACT

A tool pack assembly for the drawing and ironing of containers wherein the ironing and guiding dies are movably mounted for automatic centering thereof to regain axial realignment thereof with the axis of the provided punch should such disc shift from alignment. The assembly includes a redraw dye or ring to receive the blanked container and associated support and ram with the ironing dies being spaced therefrom for ironing of the container as the same is driven therepast by movement of the ram. Ironing dies are mounted for radial floatation within a housing, and biasing means are spaced peripherally thereabout to bring the ironing dies and guides into axial relationship with the ram. The assembly further includes a stripper die assembly for removal of the finally formed container which die is similarly radially floatable and similarly biased to bring the die into axial relationship with the container and container driving punch. A primary aspect of the invention is to provide a self-centering tool assembly to correct any jambing of the unit which may have occurred during the ironing process.

9 Claims, 3 Drawing Figures

TOOL PACK ASSEMBLY

FIELD OF THE INVENTION

This invention relates generally to ironing mechanisms for the final forming of containers and more specifically to an improved ironing, tool pack assembly for use with a ram which in combination reduces the sidewall of a cup blank from which the container is formed and wherein the various dies or tools are radially floatable and automatically centered with regard to the axial line of ram movement.

SUMMARY OF THE INVENTION

The present invention relates to the drawing and ironing of blanked containers whereby the thickness of the container wall is reduced and controlled. The tool pack to provide the controlled reduction includes a normally supplied re-draw assembly and axially aligned guiding assemblies within the pack for the ironing of the container wall and further includes various ironing dies or tools which are arranged in radially floating relationship within the assembly with automatic centering means arranged around the periphery thereof such that should the ironing dies or tools be shifted from a normal axial arrangement with the ram, they will be automatically urged to proper axial alignment with the ram. With the applicant's conept, a plurality of biasing members are arranged in spaced relation about the periphery of the various ironing dies or tools and guiding members and similarly, a stripper dye is biased in the same manner. With the applicant's concepts, a plurality of biasing members urge the ironing dies and stripper die into proper axial alignment, the members being individual, self-contained units which cooperate with the other such centerunits for the required centering, which units are not interconnected in any manner other than by the forces they individually apply. The individual units are then individually replaceable and will exert a uniform centering force upon the radially floatable ironing dies and stripper die.

BACKGROUND AND OBJECTS OF THE INVENTION

The present invention relates generally to ironing and drawing mechanisms for the production of the container portions of two-piece containers.

The art for making cans and containers through such a method is well known in the art and various prior art patents exist which disclose the same. Various of these patents include stuctural mechanisms for maintaining ironing dies and stripper dies of such apparatus in floating fashion and in self-centering fashion.

Certain prior art patents applicable to the self-centering concept include patents to Maeder, U.S. Pat. No. 4,262,512; Schaffer, U.S. Pat. No. 4,183,237; and, British Pat. No. 724,251.

The patent to Maeder does include a plurality of biasing members which act directly upon the periphery of a die retaining member and this patent further illustrates the concept of the stripper die assembly being radially floatable and being brought into a centering position through the use of biasing members.

In contrast to Maeder, which illustrates the pertinent art, applicant's concept provides radially floatable ironing dies and guiding members wherein pairs of such members, such as an ironing die and a guiding die, may be arranged in side-by-side fashion axially along the path of the punch and container being drawn, and wherein a centering force is applied to such side-by-side members through a pin element which is radially biased and which contacts the entire longitudinal dimension of the die housing ring containing the members. With the applicant's concept, then, the centering force is applied entirely along the longitudinal dimension of the die-carrying rings and the equality of action prevents any cocking of either the ring or the individual members upon the recentering action. This arrangement, then, provides a uniformity of centering force to the tool-bearing ring element and this same concept is utilized on the stripper die assembly wherein the biasing force is properly distributed along the longitudinal dimension of the stripper die housing member.

A basic problem in ironing containers is the possible misalignment and jamming that results from misalignment of the ram and carried container with respect to the dies. With the applicant's invention the dies are properly centered upon the removal of the exterior force of the ram and carried container.

It is therefore an object of the applicant's invention to provide a tool pack assembly for the drawing and ironing of containers which includes means for automatic centering of the ironing and guiding dies when external forces are removed therefrom.

It is a further object of the applicant's invention to provide a tool pack assembly which permits the arrangement of ironing and guiding dies in axially adjacent position wherein a centering force is simultaneously applied thereto and is similarly applied along the entire longitudinal dimension of the combination.

It is still a further object of the applicant's invention to provide automatic centering for dies of a tool pack assembly for the re-drawing and ironing of containers wherein a plurality of individual biasing members are provided with each of the individual members including an independent biasing structure acting against a single element which extends the entire longitudinal dimension of either a single die-holding element of a multiple die structure.

These and other objects and advantages of the applicant's invention will more fully appear from a consideration of the accompanying drawings and disclosure made in connection with such drawings.

DESCRIPTION OF A PREFERRED FORM OF THE INVENTION

Figure 1:
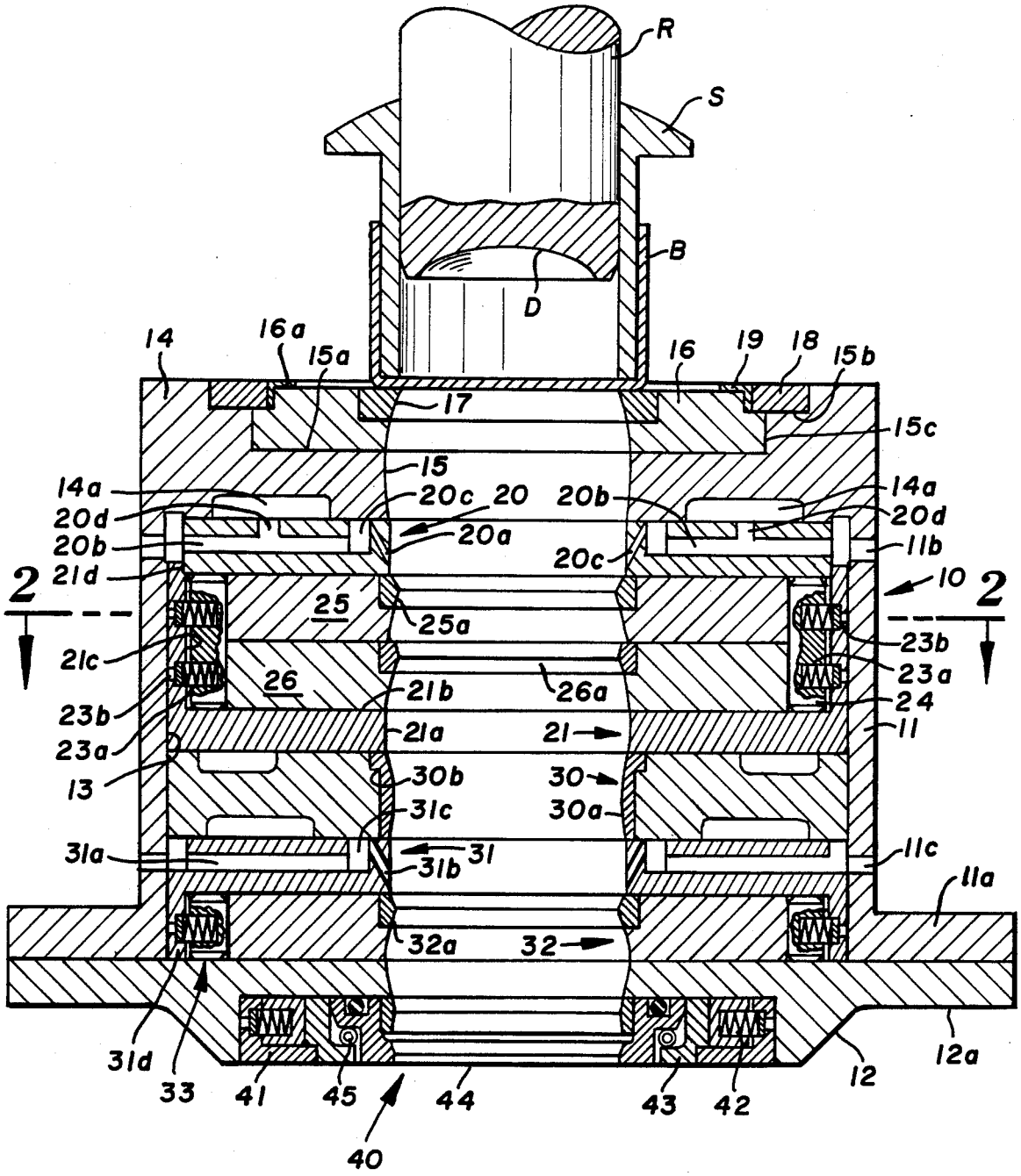
FIG. 1 is an axial section of a tool or die pack for the drawing and ironing of containers.

In accordance with the accompanying drawings, FIG. 1 is an illustration of a tool pack assembly, generally designated 10 which is designed and constructed for placement into a unit, not shown, which unit provides other facilities for the use of the pack for the redrawing and ironing of containers. Such other facilities include a ram R and a can blank support S for positioning and ultimate forming of the desired container from the blank B. As illustrated, the ram R is formed with a proper end structure, such as the dome D, for the formation of the container end.

The units to which the tool pack will be mounted are well known in the art and no further description of the same is deemed necessary.

The tool pack 10 includes a pair of housings 11, 12 which may be joined together at and through a flange arrangement 11*a*, 12*a* with connective elements, not shown, arranged to connect the flanges 11*a*, 12*a*. Housing 11 includes a longitudinally extending cavity portion 13 to receive ironing and guiding elements therein and is provided with a radially inwardly extending end 14 defining an aperture 15 therethrough, which end further defines a die receiving shoulder 15*a* and a retainer receiving shoulder 15*b* in axial alignment with aperture 15. As further illustrated in FIG. 1, the external wall of housing 11 defines a plurality of fluid passing apertures 11*b*, 11*c* radially therethrough for the admission of fluid internally of the housing. It should be obvious that, as such apertures are designed for the passage of fluid, fluid connecting arrangements must be provided in conjunction with said apertures.

A re-draw die 17 is provided for initially re-drawing the blank B and this die 16 is received in a die housing 16 which is received into bore 15*c* and thus be received against shoulder 15*a*. The upper surface of die housing 16 may be shouldered as at 16*a* to cooperate with a locking fixture which, in the form shown, includes a circular locking ring 18 and a shouldered locking and hold down ring 19 to positively hold the die housing 16 to the housing 11.

In the form and configuration shown, applicant provides a spacer member 20, generally circular in shape and having an axially aligned aperture 20*a* therethrough and having radially extending passages 20*b* formed therein such that the same will be in fluid receiving alignment with the aforementioned apertures 11*b* of housing 11 and further being provided with angularly directed fluid dispensing passages 20*c* to direct lubricating fluid to a next adjacent die section. An axially extending passage 20*d* may communicate with passage 20*b* for delivery of fluid to a cavity 14*a* formed in housing end 14.

A dual die housing member 21 is provided within cavity 13 and includes an aperture 21*a* therethrough and a die receiving area defined by a radially extending section 21*b* and a longitudinally extending wall 21*c*. It should be noted that the uppermost end of such wall 21*c* is similarly shouldered to receive spacer 20. Member 21 is securely fitted to cavity 13 through proper machining tolerances. Die housing 21 is ring or circular in shape and is provided of a diameter slightly larger than the diameters of the die rings 25, 26 to permit the same to move within the inner, longitudinally extending wall 21*c*. As illustrated, the die rings 25, 26 are respectively provided with die elements 25*a*, 26*a* for ironing of the container as the same is forced therepast by the ram R.

Figure 2:
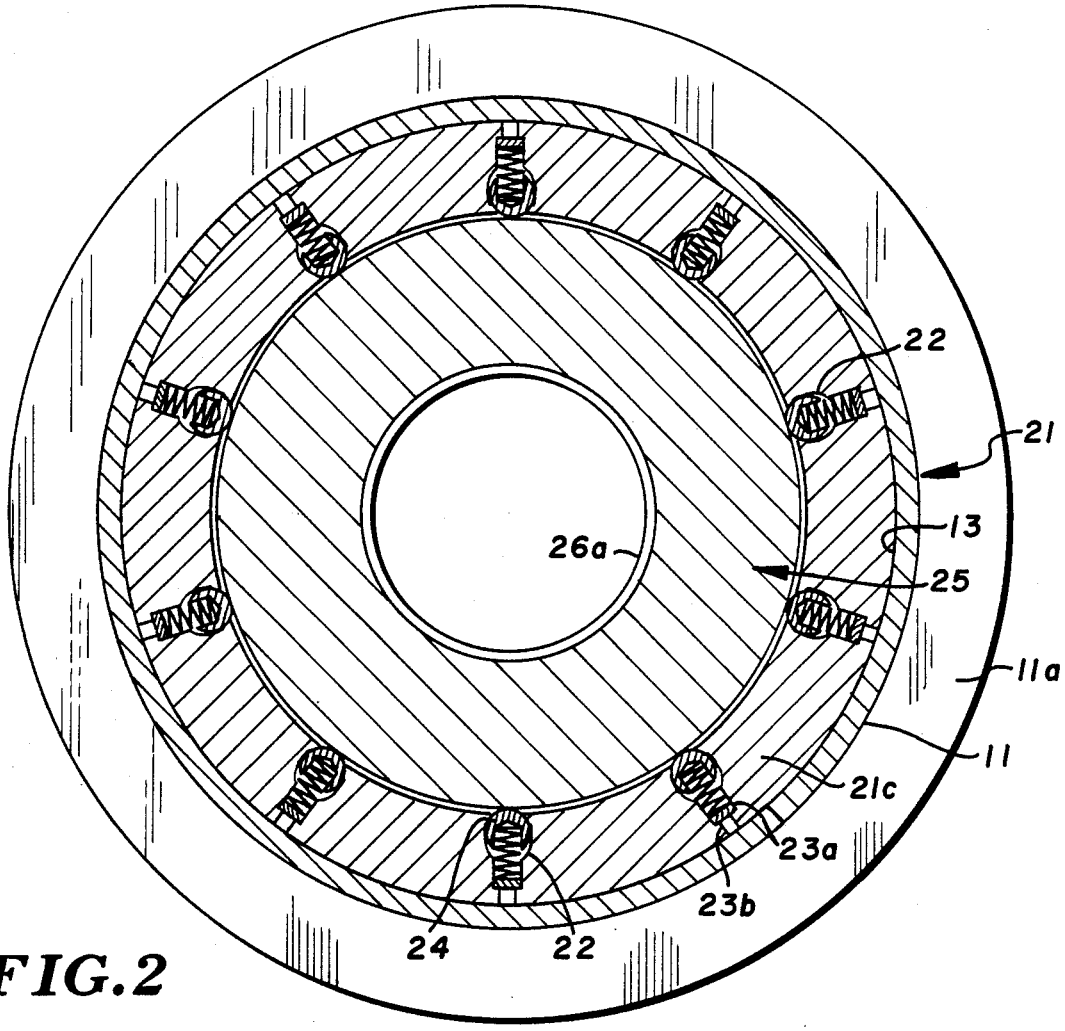
FIG. 2 is a radial sectional taken substantially along Line 2—2 of FIG. 1; and, FIG. 3 is a typical section taken along Line 3—3 of FIG. 2 and being drawn to an enlarged scale.
Figure 3:
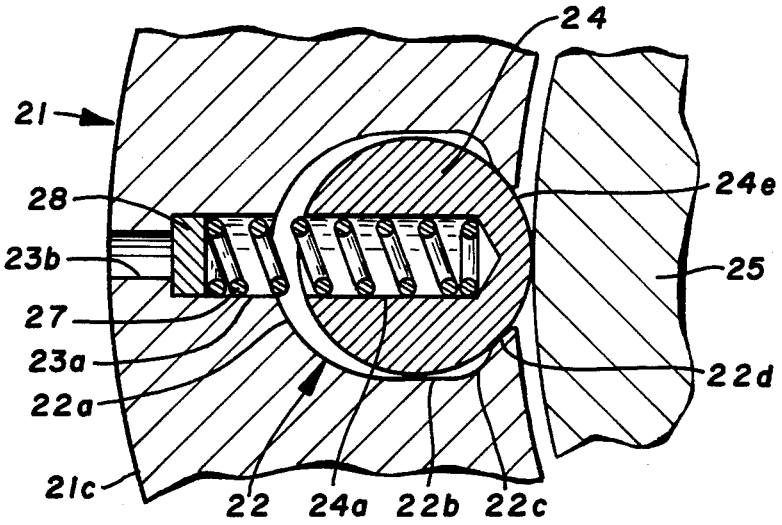

As particularly illustrated in FIGS. 2 and 3, the longitudinal extending wall 21*c* of housing 21 is provided with a plurality of longitudinally extending, pin receiving apertures 22 with radially extending, biasing member receiving and retaining apertures communicating therewith. Such apertures are of two sections and these are designated respectively 23*a*, 23*b*. The pin members are designated 24. As illustrated, the pins 24 are of such a length that two such biasing structures are provided along the length thereof with each such biasing structure including a biasing spring 27 receivable into aperture sections 23*a* and resting therein against a stop element 28 with the other end of such biasing spring 27 being received into an aperture 24*a* in the pin 24. The purpose of the stop element 28 is to permit removal of the biasing spring by insertion of a removal rod through aperture section 23*b*. Collapse of the biasing spring 27 into the pin aperture 24*a* will permit removal and insertion of the same into the formed longitudinal passage 22.

The particular shape of the pin aperture 22 consists of several curvilinear sections. A first section is designated 22*a* with a section 22*b* parallel to the axis of apertures 23*a*, 23*b* adjacent thereto a second curvilinear section 23*c* adjacent thereto and terminating in a third section 22*d* having the same curvature as pin 24 to finally result in a pin exposing opening 24*e* through which the pin 24 may extend to abut with the exterior surface of die rings 25, 26. The shape and dimensions of this pin receiving aperture 22 is precisely determined.

Is an important aspect of this invention that the biasing member exert the centering force entirely longitudinally of the die ring so as to prevent possible cocking thereof when centering takes place and to insure the same, the pin member is of a length equal to the height of a die ring or, in this particular section equal to the height of two adjacent such die rings which are arranged in the die housing member 25.

Arranged in succeeding relation to the die housing member 21 is a guiding member 30 and this member is provided with a guiding bushing 30*a* positioned on member 30 through a shoulder 30*b* configuration. Guiding member 30 is fitted securely into cavity 13 of housing 11 and abuts with the bottommost surface of the housing member 21.

Arranged in next succeeding relation to guide member 30 is a spacer member identical to spacer 20 but in this instance being designated 31 with the only difference between the same being the omission of a longitudinal aperture communicating with radial aperture 31*a*. The angularly directed aperture 31*b* is again illustrated for the introduction of lubricating fluid to the axial passage of container movement and particularly to the next succeeding ironing die 32. It should be obvious that the aperture 31*a* is positioned relatively to the aperture 11*c* through housing 11 for flow of fluid therethrough.

The axially angular apertures 20*c*, 31*b* of spacers 20 and 31 have been mentioned. In actual construction of the spacers, a plurality of such apertures or passages are provided and are arranged to direct fluid co-angularly or in a spiral fashion towards the next succeeding die or dies. To accomodate feeding a plurality of such passages, the radially extending passages 20*b*, 31*a* terminate in a circular groove 20*d*, 31*c* for such fluid transmission.

In accordance with the illustration of FIG. 1, spacer 31 also provides a die ring receiving and housing structure and to provide the same includes a downwardly directed outer wall 31*d* in which a plurality of biasing members and pin structures 33 are provided. The configuration of such biasing members is identical to the biasing members and structures described hereinabove with the only exception being the height thereof as the unit is acting against a single die ring 32. Die ring 32 obviously is provided with a die 32*a*.

The elements of the pack so far described are held within the cavity 13 by the flange 12.

Arranged within flange 12 is a stripper die structure 40. The purpose of the stripper die 40 is to remove the formed and ironed container from the ram after the same has passed through the tool pack 10. Retraction of the ram will carry the formed container therewith and the container will come into abutment with the stripper die upon such return such that the same will be removed from the ram.

Such stripper configuration is known in the art and applicant improves upon the same by having the centering concept incorporated therein. As illustrated in FIG. 1, a shouldered housing ring 41 is locked into flange 12 and the biasing structure 42, again being identical to those described is provided in such housing 41 with the same acting against the actual L-shaped stripper housing 43. The actual stripping device 44 is of an inverted L-shaped configuration to be received in inverted position within the stripper housing 43 and the stripping device may consist of a plurality of arcuate segments which are biased by biasing member 45 to initially allow passage of the formed container and ram therethrough and to thereafter close upon one another to form a passage of reduced diameter to allow return passage of the ram but prevent the formed container from reverse passage through the pack.

As stated, the stripper construction is provided with the centering elements and structure to insure axial alignment of the stripper to the passage of the ram and container being ironed.

The function of the applicant's device should be obvious to anyone skilled in the art. The blank container is obviously moved by the ram through the re-draw die and then succeedingly through the various ironing dies. The floatation or moveability of the dies will permit them to be shifted from their normal axial position upon any possible shifting of the ram for any reason but will provide for return of the dies to axial relation upon the removal of the off-centering force. The applicant's unit insures proper re-centering due to the proper longitudinaly application of the centering force against the die ring or die ring housing.

What I claim is:

1. A tool pack assembly for use in an ironing press which press is provided with a ram moveable along an axial path of the tool pack assembly to reduce the thickness of the wall of a cup, said tool pack assembly including:

a. a longitudinally extending housing providing a longitudinally extending cavity therein for the housing of the tool pack components;

b. a re-draw die assembly arranged on one end of said housing for initial sizing of a cup blank as the same is driven therethrough by the ram of the press;

c. at least one ironing die assembly arranged in said cavity and of a diameter to permit radial shifting thereof, said die assembly including a circular die support member and an ironing die mounted generally centrally thereof;

d. a plurality of centering means arranged within said cavity and being spaced arcuately therein about said ironing die assembly, said centering means including a plurality of individually acting longitudinally extending pin members having their longitudinal axis parallel to the axial path of the tool pack assembly and pin biasing members each of which is arranged and constructed to provide a centering force against said ironing die assembly entirely along the longitudinal dimension thereof; and, e. a stripper die assembly arranged on the other end of said housing permitting the formed container to pass therethrough in one direction and preventing return of the container upon return of the ram through said tool pack assembly whereby the formed container is removed from the ram.

2. The tool pack assembly as set forth in claim 1 and said centering means including a plurality of longitudinally extending pin housing passages, a pin member arranged within each of said passages, said passages being of a size to permit radial movement of said pin while maintaining the same in parallel relation to the axis of said pack, said biasing members normally forcing said pin radially inwardly to center said ironing die assembly.

3. The tool pack assembly as set forth in claim 2 and said biasing member including a compression spring member.

4. The tool pack assembly as set forth in claim 1 including:

a. said stripper die assembly being arranged for radial shifting with respect to the axis of said tool pack; and, b. a plurality of centering means arranged about said stripper die assembly to provide a centering force thereagainst upon axial shifting thereof.

5. The tool pack assembly as set forth in claim 1 and at least a pair of spaced apart ironing die assemblies arranged in said cavity and being arranged for radial shifting therein and centering means being provided for each of said assemblies.

6. The tool pack assembly as set forth in claim 1 and at least a second ironing die assembly arranged in said cavity and of a diameter to permit radial shifting thereof and being arranged longitudinally adjacent to the other said ironing die and centering means being arranged to provide a centering force simultaneously to said adjacent die assemblies.

7. The tool pack assembly as set forth in claim 6 and said simultaneous centering force applying means including pin means of a longitudinal dimension substantially equal to the combined longitudinal dimension of said adjacently arranged die assemblies.

8. The tool pack assembly as set forth in claim 7 and said pin biasing members including at least a pair of longitudinally spaced biasing members to co-act against said pin to force the same radially inwardly.

9. The tool pack assembly as set forth in claim 1 including a plurality of ironing die assemblies, each of said assemblies being arranged for radial shifting within said housing and each of said assemblies including centering means.

* * * * *